US010334352B2

(12) United States Patent
Daley et al.

(10) Patent No.: US 10,334,352 B2
(45) Date of Patent: Jun. 25, 2019

(54) HEADPHONE PIVOT JOINT

(71) Applicant: Bose Corporation, Framingham, MA (US)

(72) Inventors: Bennett Daley, Waltham, MA (US); Benjamin Eisenberg Zelnick, Somerville, MA (US)

(73) Assignee: Bose Corporation, Framingham, MA (US)

( * ) Notice: Subject to any disclaimer, the term of this patent is extended or adjusted under 35 U.S.C. 154(b) by 76 days.

(21) Appl. No.: 15/721,834

(22) Filed: Sep. 30, 2017

(65) Prior Publication Data

US 2019/0104356 A1 Apr. 4, 2019

(51) Int. Cl.
*H04R 1/10* (2006.01)

(52) U.S. Cl.
CPC ..... *H04R 1/1066* (2013.01); *H04R 1/1008* (2013.01)

(58) Field of Classification Search
CPC .. H04R 1/1033; H04R 1/1058; H04R 5/0335; H04R 1/105; H04R 1/1066; H04R 1/1008; H04R 1/10
USPC ..... 381/384, 378
See application file for complete search history.

(56) References Cited

U.S. PATENT DOCUMENTS 9,900,682 B2 2/2018 Breen et al.
2015/0195640 A1* 7/2015 Essabar ..... H04R 1/1033 381/378
2015/0281823 A1* 10/2015 Taylor ..... H04R 1/1066 381/384

FOREIGN PATENT DOCUMENTS

WO 2017/155860 A1 9/2017

OTHER PUBLICATIONS

Unpublished U.S. Appl. No. 15/422,341, filed Feb. 1, 2017; Applicant Bose Corporation.
Unpublished PCT Application No. PCT/US2018/016350 filed Feb. 1, 2018; Applicant Bose Corporation.
Unpublished U.S. Appl. No. 15/874,108, filed Jan. 18, 2018; Applicant Bose Corporation.
Unpublished U.S. Appl. No. 15/435,682, filed Feb. 17, 2017; Applicant Bose Corporation.

* cited by examiner

*Primary Examiner* — Curtis A Kuntz
*Assistant Examiner* — Julie X Dang
(74) *Attorney, Agent, or Firm* — Brian M. Dingman; Dingman IP Law, PC

(57) ABSTRACT

An earcup to headband joint for headphones, wherein the headphones comprise an electrical cable that extends from the headband into the earcup. The earcup to headband joint includes joint structure that couples the earcup to the headband and that is constructed and arranged to provide for earcup translation along a vertical axis and rotation about the vertical axis, and at least one friction element in the earcup and in contact with at least one of the joint structure and the cable. The friction element is constructed and arranged to provide forces that resist rotational motion of the earcup about the vertical axis.

19 Claims, 16 Drawing Sheets

HEADPHONE PIVOT JOINT

BACKGROUND

This disclosure relates to an earcup to headband joint for headphones.

Many headphones have one or two earcups that are designed to sit on or over the ears. The earcups are coupled to a headband. In some cases, the earcups can move vertically, up and down the headband, so that they can fit different heads. The earcups may also be able to pivot or rotate from side-to-side about the axis of vertical motion, again to accommodate different heads.

SUMMARY

All examples and features mentioned below can be combined in any technically possible way.

In one aspect, an earcup to headband joint for headphones, wherein the headphones comprise an electrical cable that extends from the headband into the earcup, includes a joint structure that couples the earcup to the headband and that is constructed and arranged to provide for earcup translation along a vertical axis and rotation about the vertical axis, and at least one friction element in the earcup and in contact with at least one of the joint structure and the cable, wherein the friction element is constructed and arranged to provide forces that resist rotational motion of the earcup about the vertical axis.

Embodiments may include one of the following features, or any combination thereof. The earcup to headband joint may include at least two friction elements. The electrical cable may have two opposed sides, and one friction element may be in contact with one side of the cable and another friction element may be in contact with the other side of the cable. A horizontal portion of the cable may run generally along a horizontal axis that is perpendicular to the vertical axis. One friction element may be above the horizontal portion of the cable and another friction element may be below the horizontal portion of the cable. The friction elements may each comprise a strip of pliable material. The friction elements may comprise an elastomer. The friction elements may be made from silicone rubber. The earcup may comprise a generally horizontal slot that the joint structure and cable pass through, and the strips may be alongside both sides of the slot.

Embodiments may include one of the following features, or any combination thereof. The at least one friction element may be spaced from the vertical axis. There may be at least two friction elements that each comprise pliable material. The earcup may comprise a slot that the joint structure and cable pass through, and the friction elements may be adjacent to both sides of the slot. The cable may pass through the joint structure. The friction element may be in contact with the joint structure at a location where the cable passes through the joint structure. The joint structure at the location where the cable passes through the joint structure may comprise a tube in which the cable is located.

In another aspect, an earcup to headband joint for headphones, wherein the headphones comprise an electrical cable that extends from the headband into the earcup, includes a joint structure that couples the earcup to the headband and that is constructed and arranged to provide for earcup translation along a vertical axis and rotation about the vertical axis, wherein the earcup comprises a slot that the joint structure and cable pass through, and at least two friction elements in the earcup, one alongside each side of the slot and in contact with at least one of the joint structure and the cable, wherein the friction elements are constructed and arranged to provide forces that resist rotational motion of the earcup about the vertical axis, wherein the friction elements comprise strips of an elastomer.

Embodiments may include one of the above and/or below features, or any combination thereof. The friction elements may be spaced from the vertical axis. The friction elements may overlap both sides of the slot. The electrical cable may have two opposed sides, and one friction element may be in contact with one side of the cable and another friction element may be in contact with the other side of the cable. The friction element may be in contact with the joint structure at a location where the cable passes through the joint structure, and the joint structure at the location where the cable passes through the joint structure may comprise a tube in which the cable is located.

DETAILED DESCRIPTION

Figure 1:
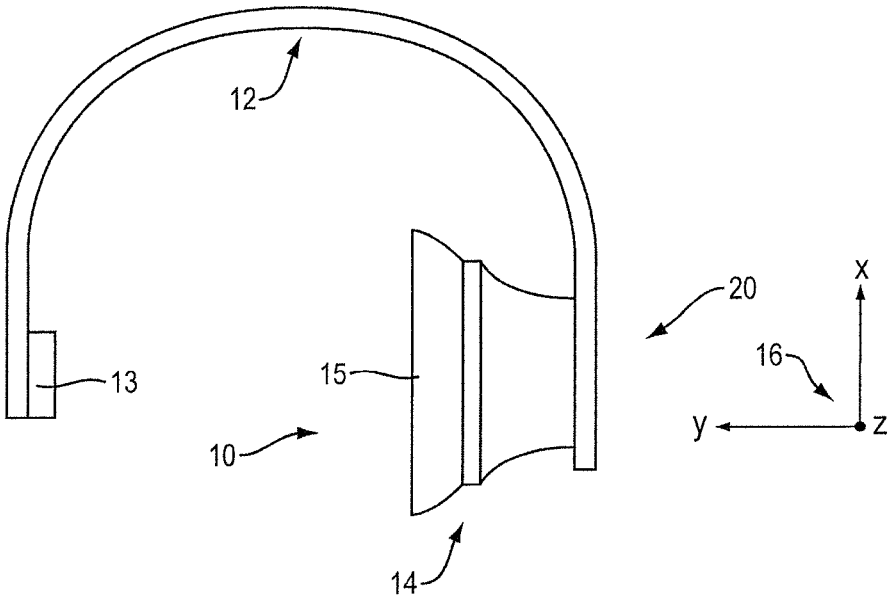
FIG. 1 is front view of a headphone.
Figure 2:
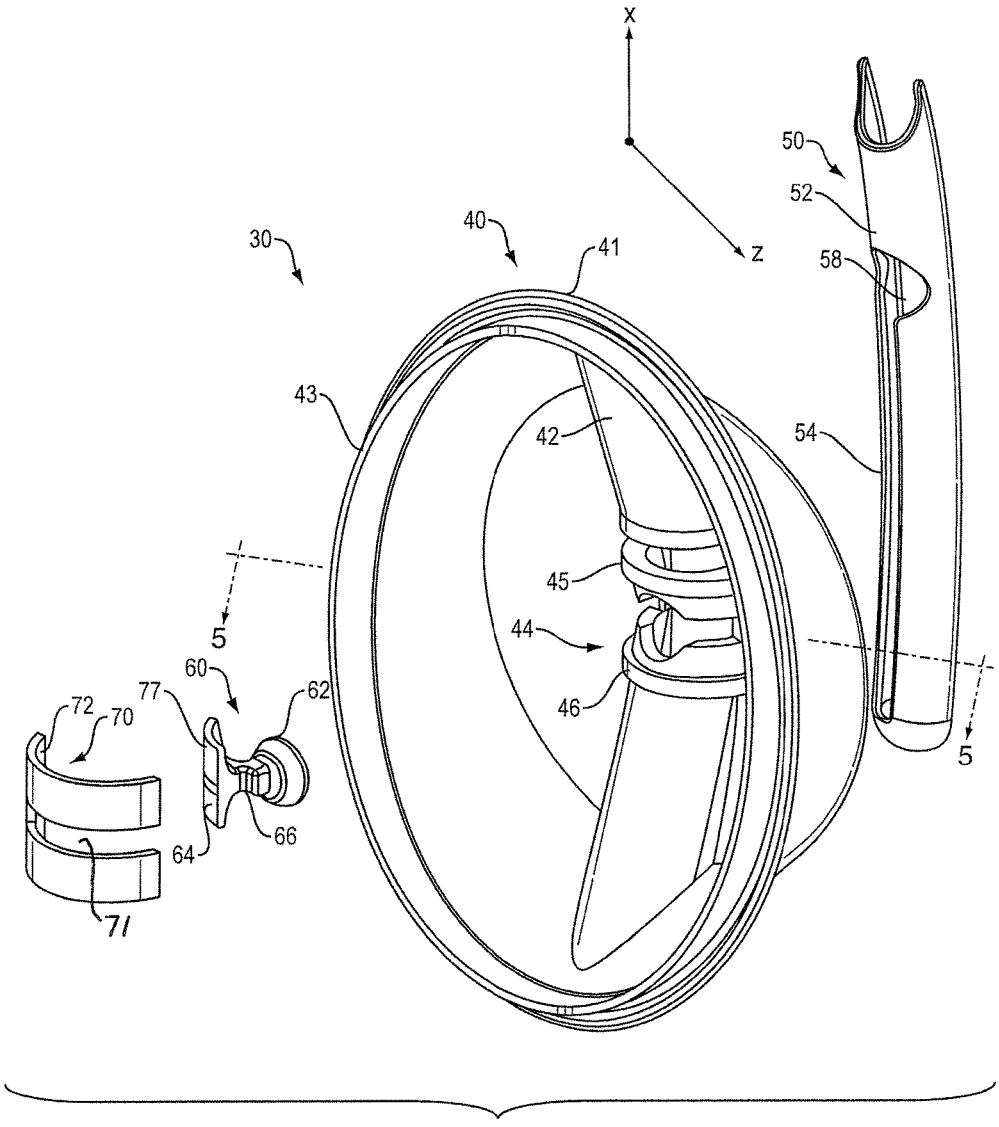
FIG. 2 is an exploded view of an earcup, and a joint that movably couples the earcup to the headband.

A headphone refers to a device that fits around, on, or in an ear, and that radiates acoustic energy into the ear canal. Headphones are sometimes referred to as earphones, earpieces, headsets, earbuds, or sport headphones, and can be wired or wireless. A headphone includes an acoustic driver to transduce audio signals to acoustic energy. The acoustic driver may be housed in an earcup. While some of the figures and descriptions following show a single headphone, a headphone may be a single stand-alone unit or one of a pair of headphones (each including a respective acoustic driver and earcup), one for each ear. A headphone may be connected mechanically to another headphone, for example by a headband and/or by leads that conduct audio signals to an acoustic driver in the headphone. A headphone may include components for wirelessly receiving audio signals. A headphone may include components of an active noise reduction (ANR) system. Headphones may also include other functionality, such as a microphone so that they can function as a headset.

In an around or on the ear headphone, the headphone may include a headband and at least one earcup that is arranged to sit on or over an ear of the user. In order to accommodate heads of different sizes and shapes, the earcups need to be able to pivot about at least the vertical axis, and they need to translate for some distance along the vertical axis. The headband can be collapsible or foldable, and can be made of multiple parts. Some headbands include sliders, which may be positioned internal to the headband, that provide for the necessary translation of the earcups. Some headphones include a yoke pivotally mounted to the headband, with the earcups pivotally mounted to the yoke, to provide for the necessary rotation of the earcups.

Some headphones have earcups that are able to move vertically, up and down the headband, and also pivot or rotate from side-to-side about the axis of vertical motion. The user experience can be improved if the side-to side pivoting motion is damped sufficiently to maintain the earcup position on the head as the headphones are used; if there is no damping the earcups may not stay in place as the wearer's head moves.

The headphones of the present disclosure have a joint that couples the earcup(s) to the headband. The joint is structured to allow constrained, damped rotation of the earcups relative to the headband about at least the vertical axis. In some cases, the joint may also provide for rotation about a perpendicular horizontal axis. The joint is also structured to provide for constrained translation along the vertical axis. Rotation about a vertical axis can extend to 90 degrees in one rotational direction, so that the earcups can be folded flat against the headband, anywhere along their translational motion. In this example of the joint, the joint allows the headphones to be folded flat, which allows a headphone storage case to be flatter than could otherwise be achieved without the joint.

An earcup to headband joint for headphones of this disclosure can include a joint structure that couples the earcup to the headband. The joint structure provides for earcup translation along the vertical axis (up and down along the headband), and earcup rotation about the vertical axis. There are one or more friction elements in each earcup. The friction elements are in contact with at least one of the joint structure and the electrical cable that extends from the headband into the earcup. The friction elements are constructed and arranged to provide forces that resist rotational motion of the earcup about the vertical axis. In one example, the friction elements are spaced from the vertical axis. The friction elements maybe located inside the earcups.

In one non-limiting example, each earcup includes two friction elements. One friction element may be in contact with one side of the cable and the other friction element may be in contact with another side of the cable. The friction elements may each comprise a strip of pliable material. The material may be an elastomer, such as a silicone rubber.

In one non-limiting example, the earcup has a generally horizontal slot that the joint structure and cable pass through, and the friction elements (e.g., the strips) are alongside both sides of the slot. In another example, the cable passes through the joint structure and the friction elements are in contact with the joint structure at the location where the cable passes through the joint structure. The joint structure at the location where the cable passes through the joint structure may comprise a tube in which the cable is located.

Headphone 10 is shown in FIG. 1. Headphone 10 includes earcup 14 that is carried by headband 12, which is adapted to be fitted on and over the user's head. Cushion 13 is depicted, to schematically represent cushioning that may be present in some headphones. Cushions may increase user comfort. Earcup 14 is movably coupled to headband 12 by joint 20. Joint 20 is constructed and arranged to allow translation of earcup 14 up and down along vertical or translational axis X. Joint 20 is further constructed and arranged to allow rotation of earcup 14 from the neutral position shown in FIG. 1, in both directions about translational axis X. In one of these rotational directions the rotation extends for approximately 90 degrees, such that the open face of ear cushion 15 of earcup 14 faces either forward or backward, rather than facing inward (i.e., toward the location of the user's head (not shown)). This rotation folds the headphone "flat," wherein the height of the headphone (i.e., its extent along the Z axis) equals the height of the earcup plus headband. In one example, this fold-flat height is approximately 54 mm. This fold-flat height is less than the height that the headphones have when the earcup is not rotated about the X axis, which would equal the diameter of the earcup; in the example of this same headphone this height would be approximately 79 mm. Since the fold-flat configuration decreases the height of the headphones, the headphone carrying case can be thinner. The fold-flat aspect of the headphones thus decreases the bulkiness of the carrying case, which makes the headphones easier to store, pack and carry.

FIGS. 2-5 provide pertinent details of one non-limiting example of an implementation of the joint structure that is constructed and arranged to allow translation of the earcup up and down along vertical or translational axis X, as well as damped rotation of the earcup in both directions about translational axis X. Damping of this rotation is discussed below. Joint structure 30 includes pivot member 60 that has first end 62. End 62 is received by slider 50, which is part of joint structure 30 and is located within the headband (not shown). Slider 50 comprises U-shaped, partially tubular body 52. Pivot member 60 also has second end 64. In this example, the distal surface of end 64 defines an arc-shaped surface 77. Integral connecting portion 66 connects pivot member first end 62 and second end 64.

Figure 3:
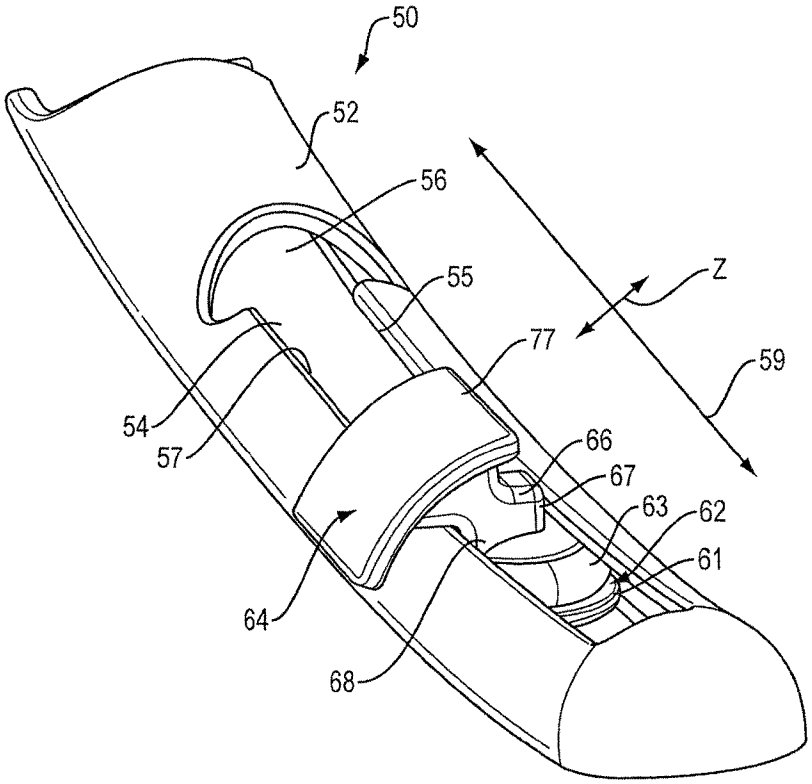
FIG. 3 shows parts of the assembled joint.

Slider 50 fits into slider receptacle groove 42 on the outside of shell body 41 of earcup shell 40. Horizontal slot 44 in groove 42, which is bounded by raised ridges 45 and 46, is sized and shaped to allow pivot member 60 to be nested into shell body 41, such that end 62 fits through enlarged opening 56 of slider slot 54. Slot 54 is narrower that the diameter of (generally spherical) end 62. This construction retains end 62 in slider 50. As shown in FIG. 3 (which leaves out the earcup shell for the sake of clarity), when the pivot member and slider are assembled, end 62 sits against the interior of slider body 52. Surface 77 of second end 64 projects from slider 50. As best shown in conjunction with FIG. 4, connecting portion 66 of pivot member 60 has ends 67 and 68 that sit against edges 55 and 57 of slider slot 54 (FIG. 3); this inhibits pivot member 60 from pivoting within slider 50 about axis 59 (which is the translational axis that corresponds to axis X, FIG. 1).

Figure 4:
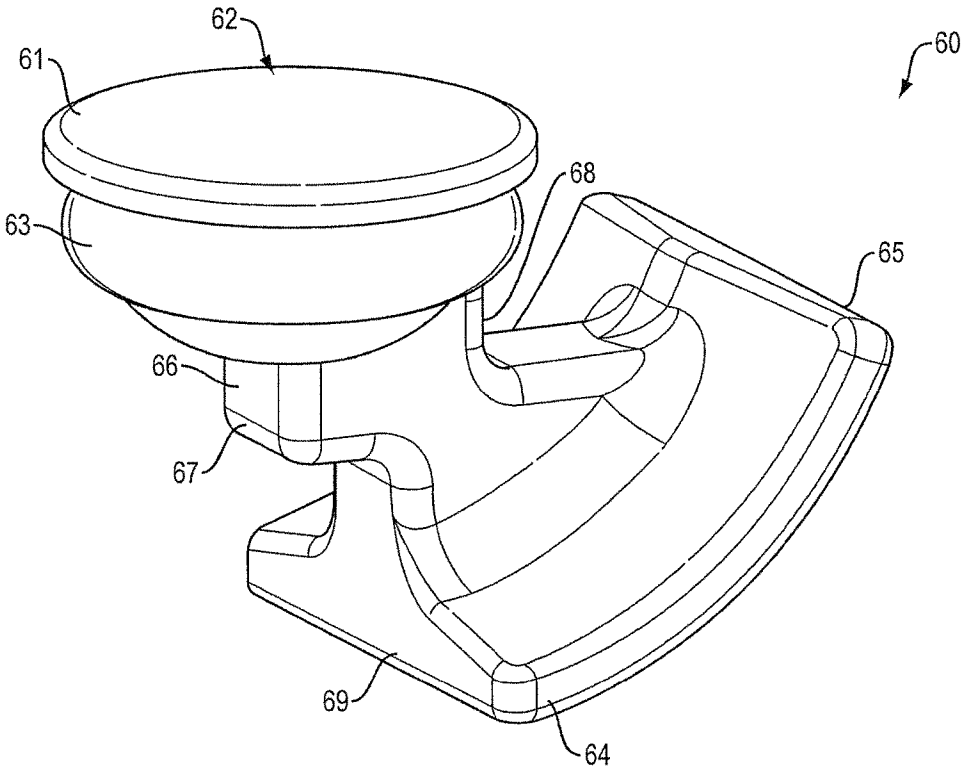
FIG. 4 shows the pivot member of FIG. 3.

As shown in FIG. 4, first end 62 includes generally disc-shaped retaining end member 61, which has a slightly greater diameter than O-ring 63. As shown in FIG. 3, O-ring 63 is fitted against the inside of slider body 52, and thus creates some friction that allows the slider to slide along axis 59, with some resistance. Slider slot 54 can be at least about 40 mm long, to allow for sliding of the earcup along the X axis of at least about 20 mm up and down from a neutral (centered) position. End 62 can pivot in both directions about the Z (horizontal) axis, until disc 61 contacts the interior of slider body 52. In one non-limiting example, the rotation about the Z axis extends for up to approximately 10 degrees from a centered (neutral) position, although smaller or greater rotations can be provided for by proper construction of the joint. The rotation about the Z axis allows the earcup to adjust relative to the headband, to accommodate different sized and shaped heads.

The rotations of the earcup about the X axis are accommodated by arc-shaped surface 77 of pivot member 60 and the arc-shaped interior bearing surface 72 of bearing member 70. See FIG. 2. Bearing member horizontal slot 71 accommodates the electrical cable that routes power and audio signals to the earcup, as described in more detail below relative to FIG. 11. As described above, pivot member 60 is held in slider 50 such that pivot member 60 cannot rotate about the X axis relative to slider 50. Bearing member 70 is coupled to earcup shell body 41 such that surface 77 sits on surface 72. This allows the earcup to be pivoted about the X axis.

Figure 5A:
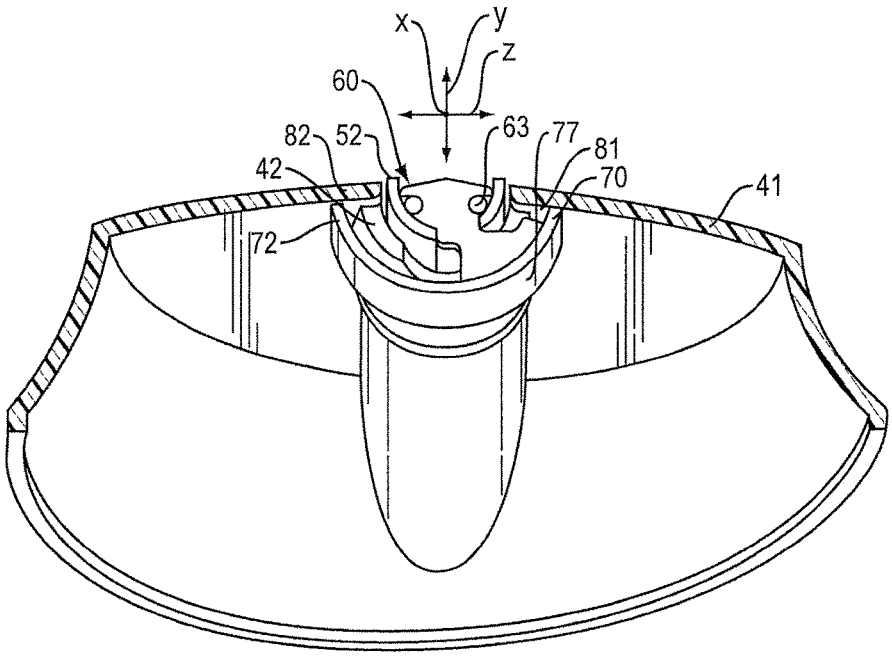
FIGS. 5A-5D are cross-sectional views taken along line 5-5 of FIG. 2 (but with the joint assembled) showing several rotational positions of the earcup relative to the slider.
Figure 5B:
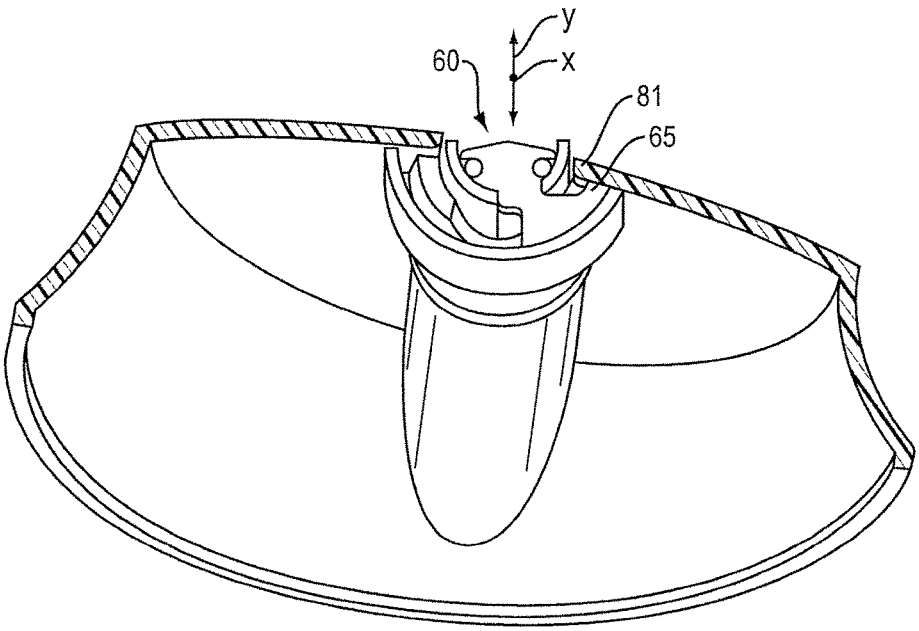
Figure 5D:
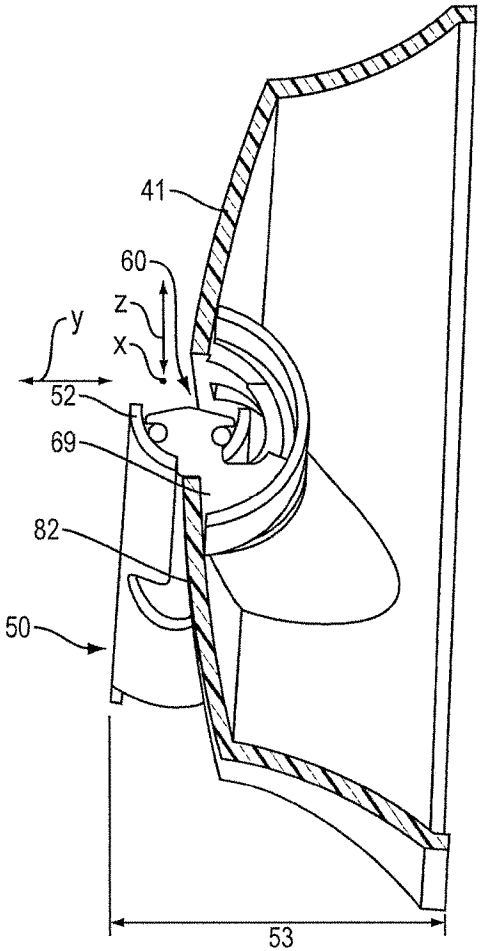
Figure 5C:
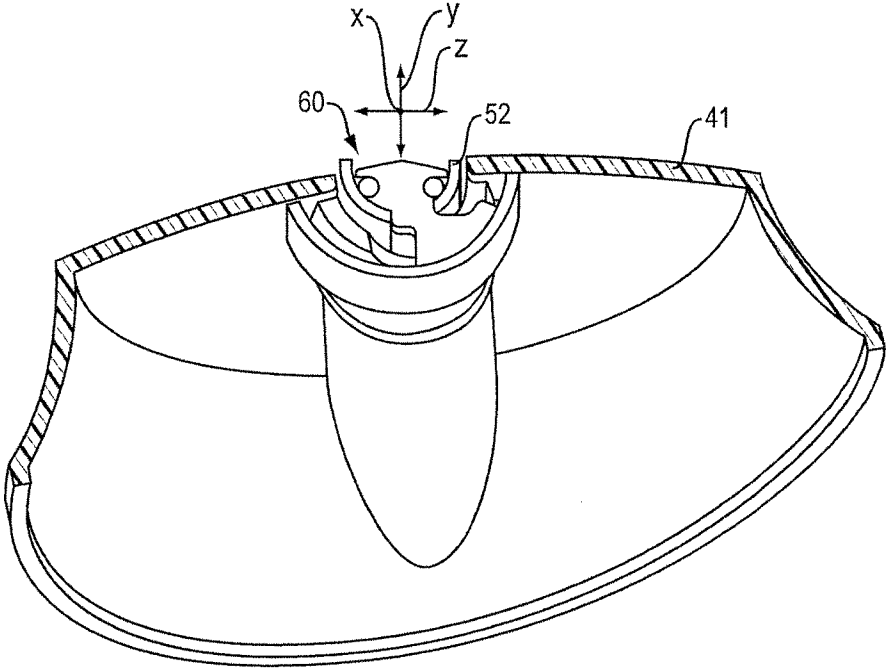
Figure 6:
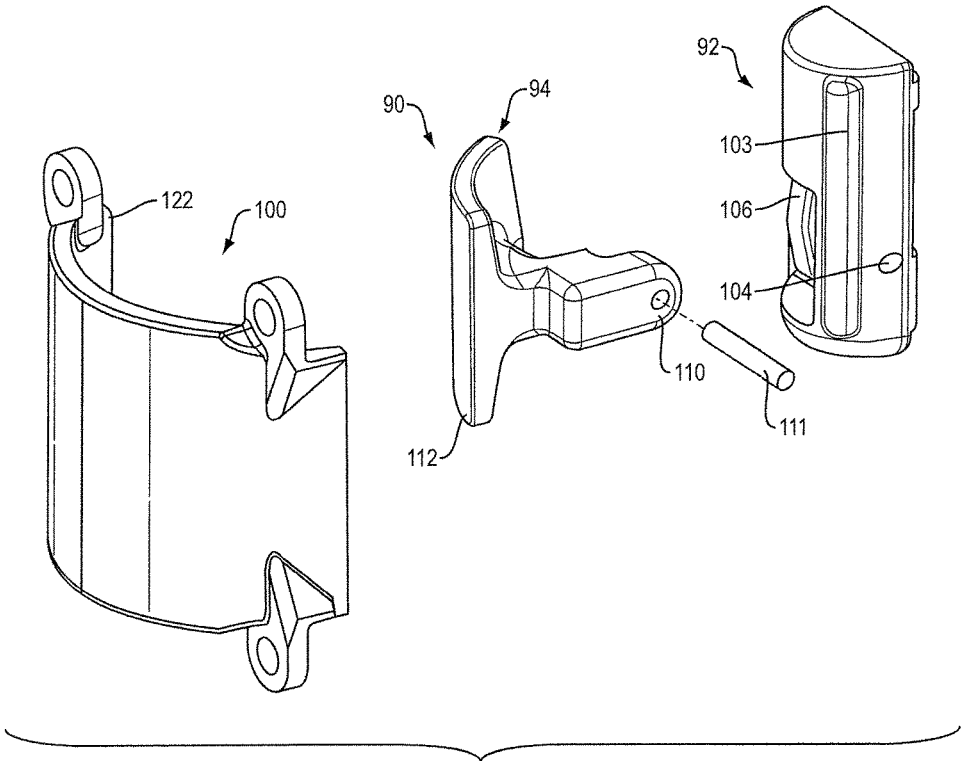
FIG. 6 is an exploded view of a pivot member and a bearing member of an alternative headphone joint.

In the non-limiting example depicted in FIGS. 2-5, joint structure 30 is constructed and arranged to allow for rotation in a first direction about the X axis (in FIGS. 5A-5D the translational (X) axis is into and out of the page), the rotation extending for about 10 degrees from a "neutral" position, and rotation of about 90 degrees in the other (a second) direction about the X axis. These rotations are illustrated in FIGS. 5A-5D, with FIG. 5A showing the "neutral" position (designated as zero degrees' rotation), FIG. 5B showing a −10 degree rotation (where the earcup is fully rotated in the first direction), FIG. 5C showing a +10 degree rotation (10 degrees from neutral in the second direction), and FIG. 5D showing a +90 degree rotation (where the earcup is fully rotated in the second direction).

In the neutral position shown in FIG. 5A the earcup is centered on the Y axis. Rotation about the X axis in the first direction can extend up to about 10 degrees as shown in FIG. 5B. The end-point is defined when end 65 of second end 64 of pivot member 60 contacts earcup shell body 41 (at point 81). As the earcup is rotated in the second direction it passes through the +10 degree location (FIG. 5C), to the second travel endpoint at +90 degrees (FIG. 5D), where end 69 of second end 64 of pivot member 60 contacts earcup shell body 41 (at point 82). In this +90 degree position the earcup lies along the Z axis, at right angles to the longitudinal axis of slider 50 (which corresponds to the X axis). The relative locations of the X, Y and Z axes are illustrated, but offset from the actual positions. As can be seen by comparing FIGS. 5A and 5D, this rotation to a "fold flat" position (FIG. 5D) substantially reduces the depth of the headphones (i.e., their extent along the Z axis), from the diameter of the earcup (FIG. 5A), to the depth of the earcup plus about half the diameter of the slider (distance 53, FIG. 5D). This substantially reduces the height needed in an earphone storage case, and thus reduces the size and bulk of the case.

An alternative pivot member/bearing member assembly 90 is depicted in FIGS. 6-9. Pivot member 91 in this case is made from two separate portions—first end 92 and second end 94. The first and second ends are interconnected via attachment structure 110 and attachment structure 106 being positioned such that their holes are aligned, with pivot pin 111 passing through opening 104 in end 92 and through holes in structures 106 and 110. This allows end 94 to pivot relative to end 92. This pivoting is about the Z axis (FIG. 1), and helps to accommodate different shapes and sizes of heads. In one non-limiting example, this pivoting extends for about 10 degrees in either rotational direction from the "neutral" position depicted in FIG. 1. Other degrees of rotation can be accomplished by proper construction of ends 92 and 94 in a manner that would be apparent to one skilled in the art.

Figure 7:
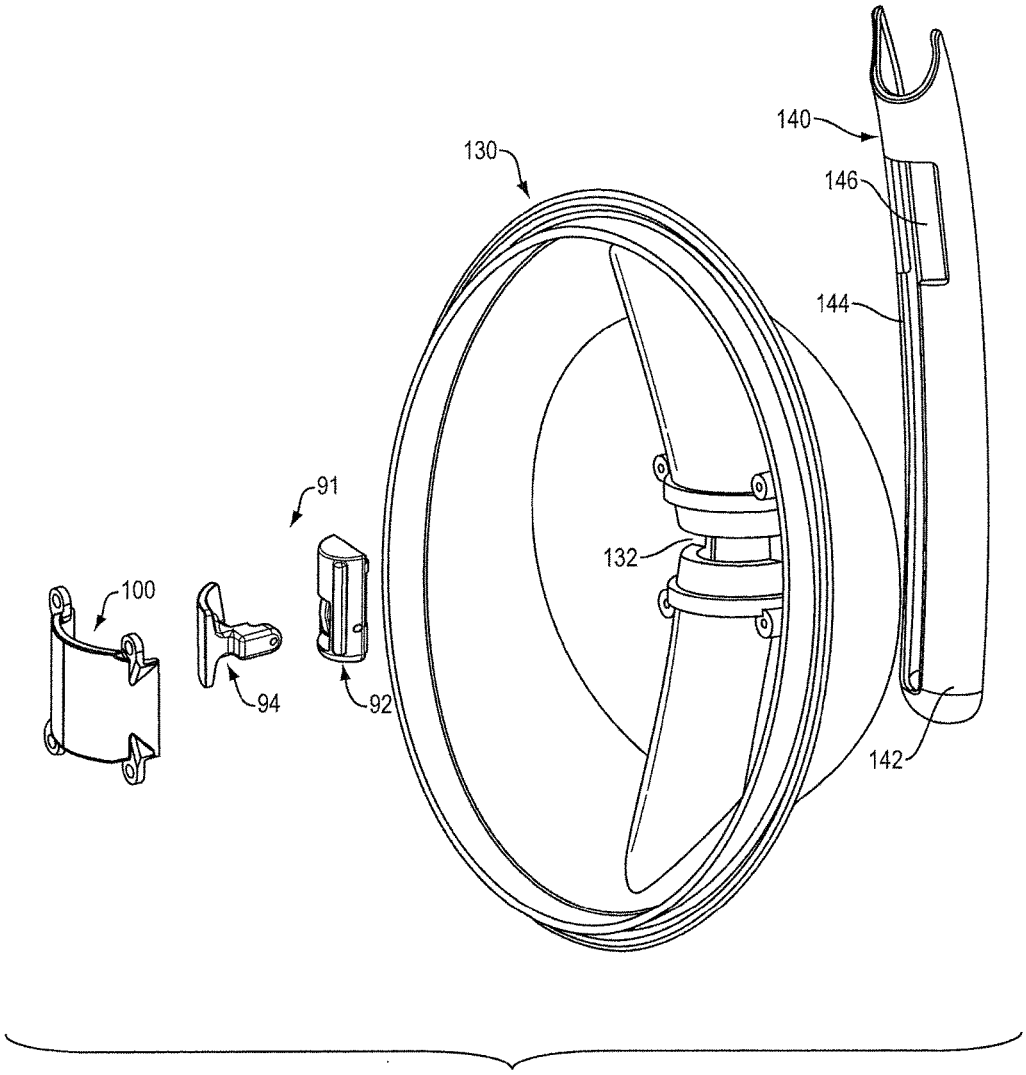
FIG. 7 is an exploded view of an earcup, a slider, and the joint of FIG. 6 that movably couples the earcup to the headband.
Figure 8:
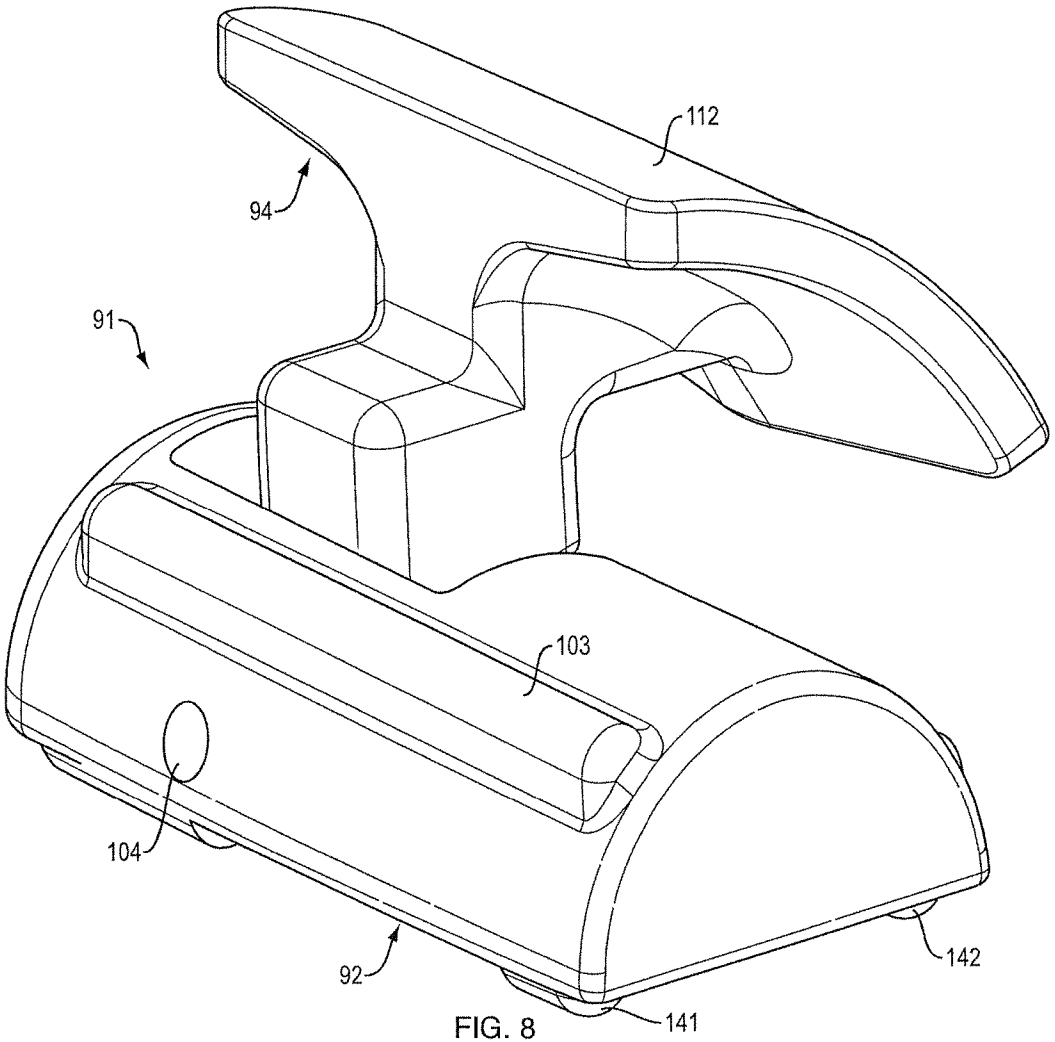
FIG. 8 shows the assembled pivot member of FIGS. 6 and 7.

First end 92 includes one or more rubber strips or portions (such as strips 103, 141 and 142, FIG. 8) that provide the frictional fit in the slider 140, in a similar manner to O-ring 63. As shown in FIG. 7, slider 140 includes slider body 142 with slot 144, and slot opening 146. Second pivot member end 94 includes arc-shaped surface 112 that rides on arc-shaped interior bearing surface 122 of bearing member 100. Earcup shell 130 includes slot 132, which has a construction that is very similar to the embodiment shown in FIG. 2. Bearing member 100 is mounted inside of earcup shell 130 via four tabs (tab 162 numbered) that overlie mating pads that are part of the earcup shell (pad 164 numbered), using fasteners such as screws. See FIG. 9.

Figure 10A:
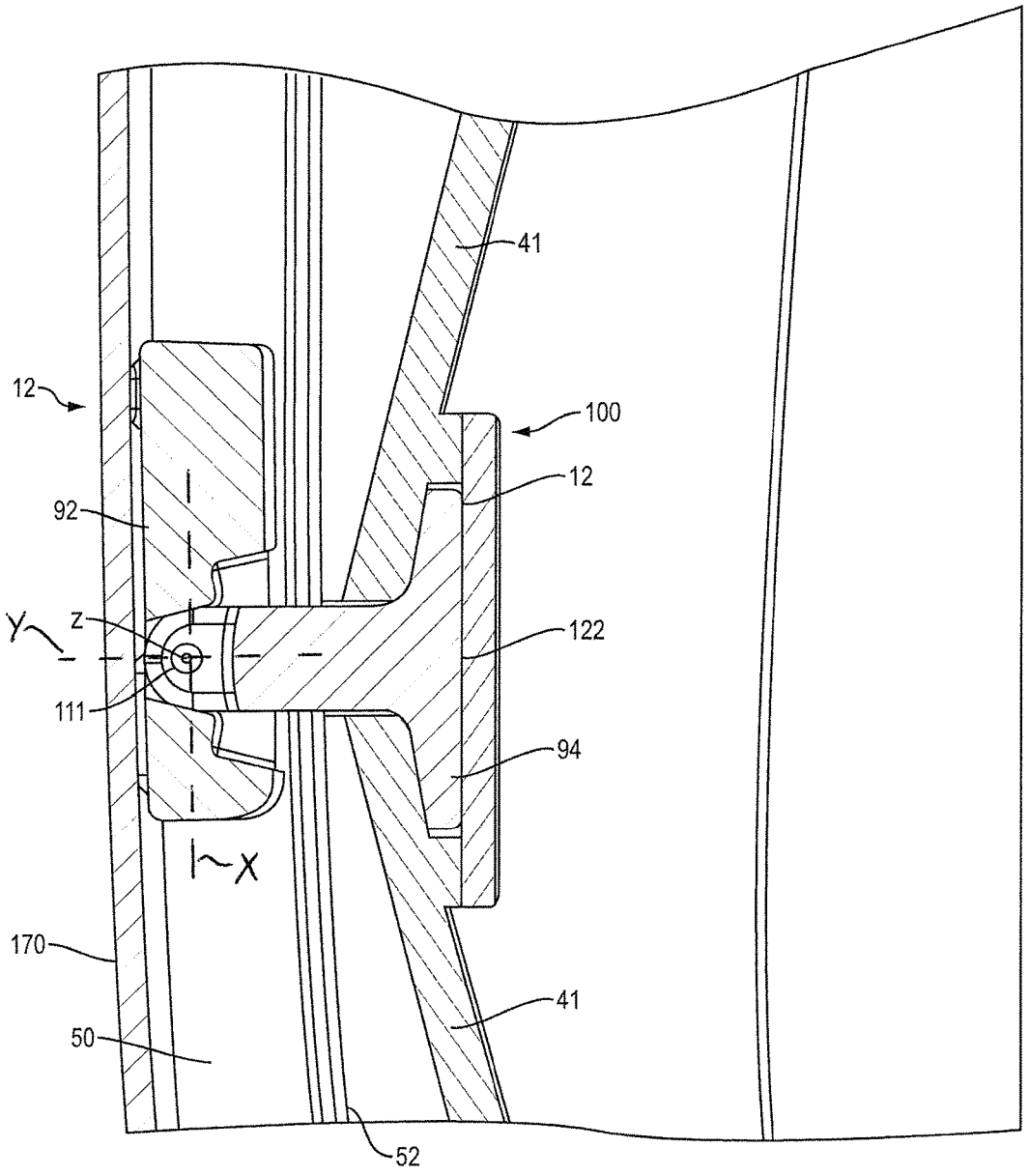
FIG. 10A is a partial cross-sectional view taken along line 10-10 of FIG. 9.
Figure 10B:
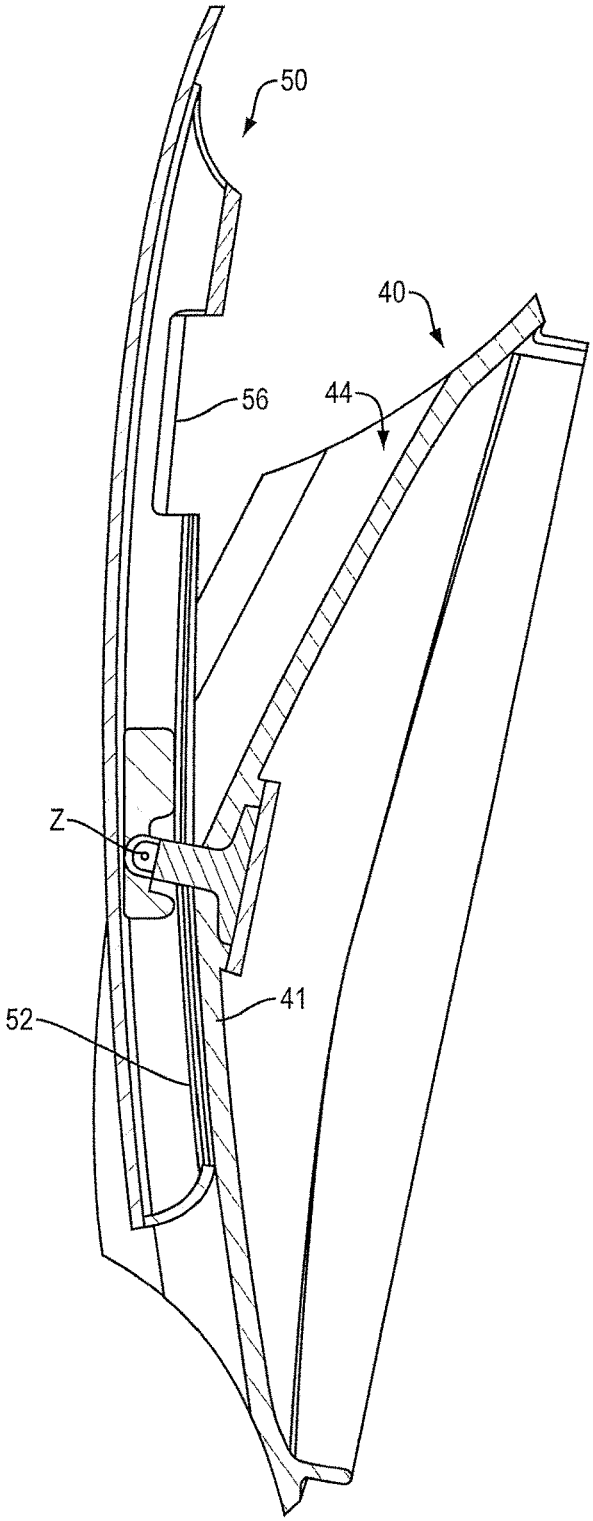
FIG. 10B is a cross-sectional view taken along line 10-10 of FIG. 9.

Constrained rotations about the Z axis can be accomplished in the manner illustrated in FIGS. 10A and 10B. The Z axis is coincident with the center of pin 111. The X and Y axes are also illustrated. Pivot member second end 94 can rotate up and down about the Z axis, relative to first end 92, which is held in slider 50. FIG. 10A illustrates the neutral position, in which the earcup is centered on the Y axis. Spring steel portion 170 of headband 12 pushes first end 92 toward bearing member 100, which is fixed to the inside of earcup shell body 41. This force also pushes second end 94 against bearing member 100, such that surface 112 rides on surface 122. The spring force thus provides for smooth rotational motion about the X axis.

FIG. 10B illustrates the farthest downward extent of rotation of earcup 40 about the Z axis, which can be approximately 10 degrees in one non-limiting example. The rotation end point (in both directions) occur when earcup shell body 41 of slot 44 contacts slider body 52. Slot 44 and slider body 52 can have the same radius of curvature to facilitate the +/−10 degree rotations, but they do not need to have the same radius of curvature.

The present headphones have earcups that are able to move vertically, up and down the headband, and also pivot or rotate from side-to-side about the axis of vertical motion. The user experience is improved by damping the side-to side pivoting motion. The damping is preferably but not necessarily sufficient to maintain the earcup position on the head as the headphones are used. The headphones have a joint that couples the earcup(s) to the headband. The joint is structured to allow constrained, damped rotation of the earcups relative to the headband about the vertical axis.

Figure 9:
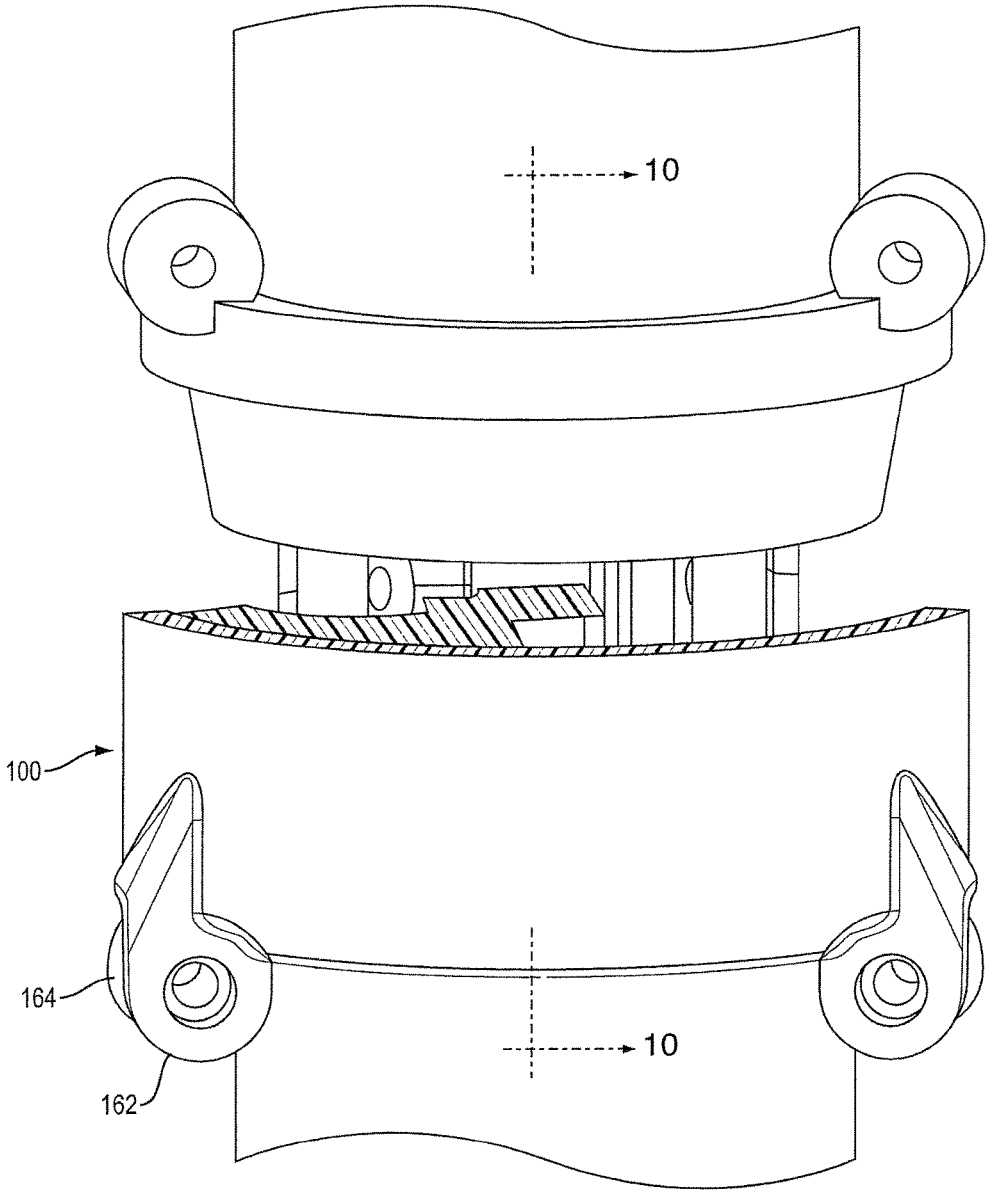
FIG. 9 is an enlarged, partial, cut-away view of an earcup/slider/pivot member assembly.
Figure 11:
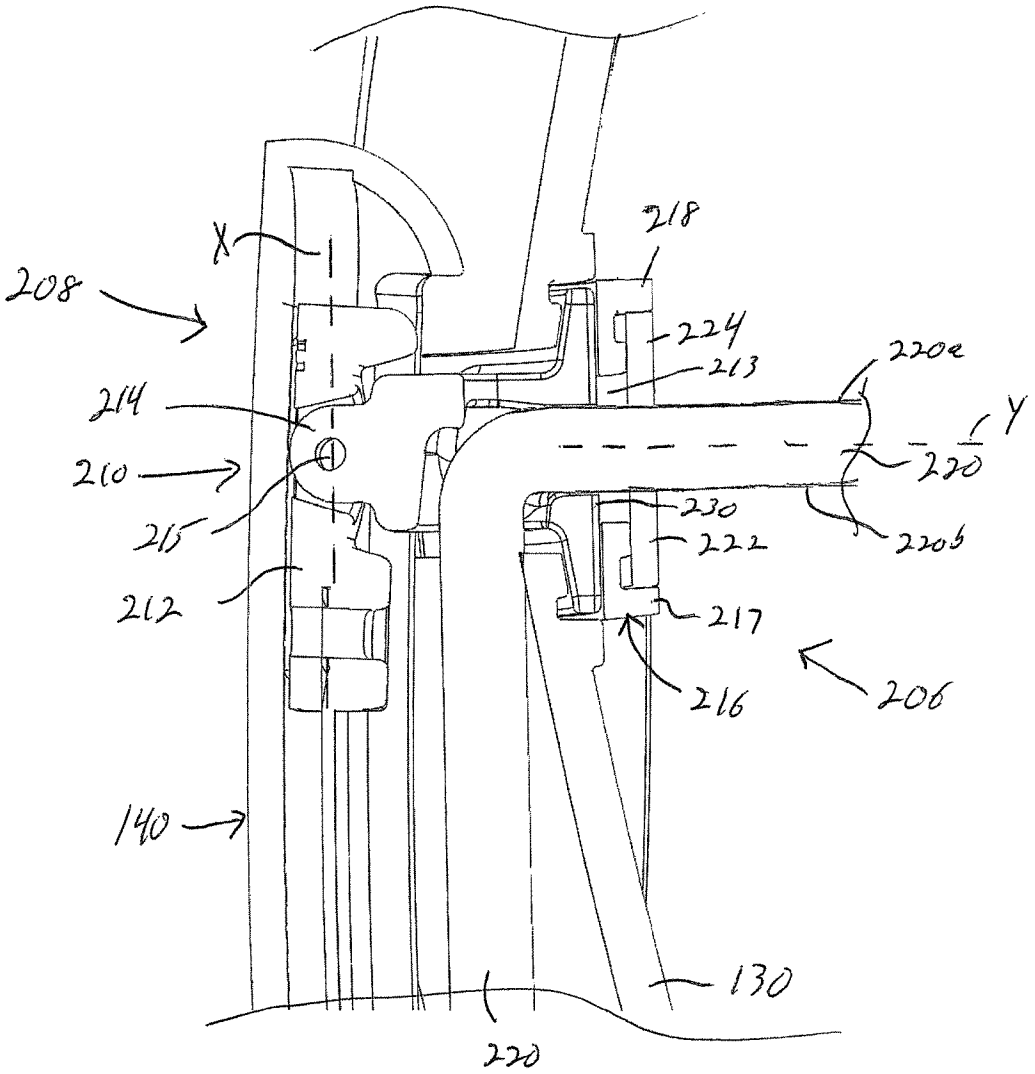
FIG. 11 is a cross-sectional view similar to the view of FIG. 10A, illustrating an electrical cable and friction members.
Figure 12:
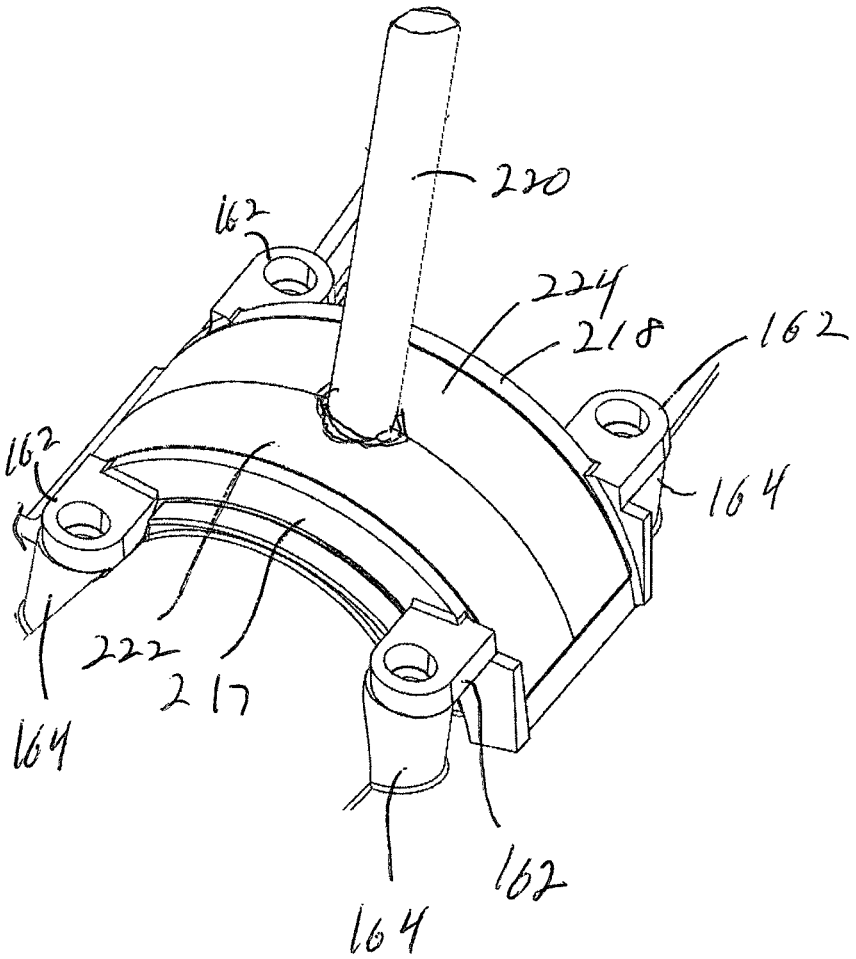
FIG. 12 is a partial, interior, perspective view, illustrating the friction members and electrical cable of FIG. 12.
Figure 13:
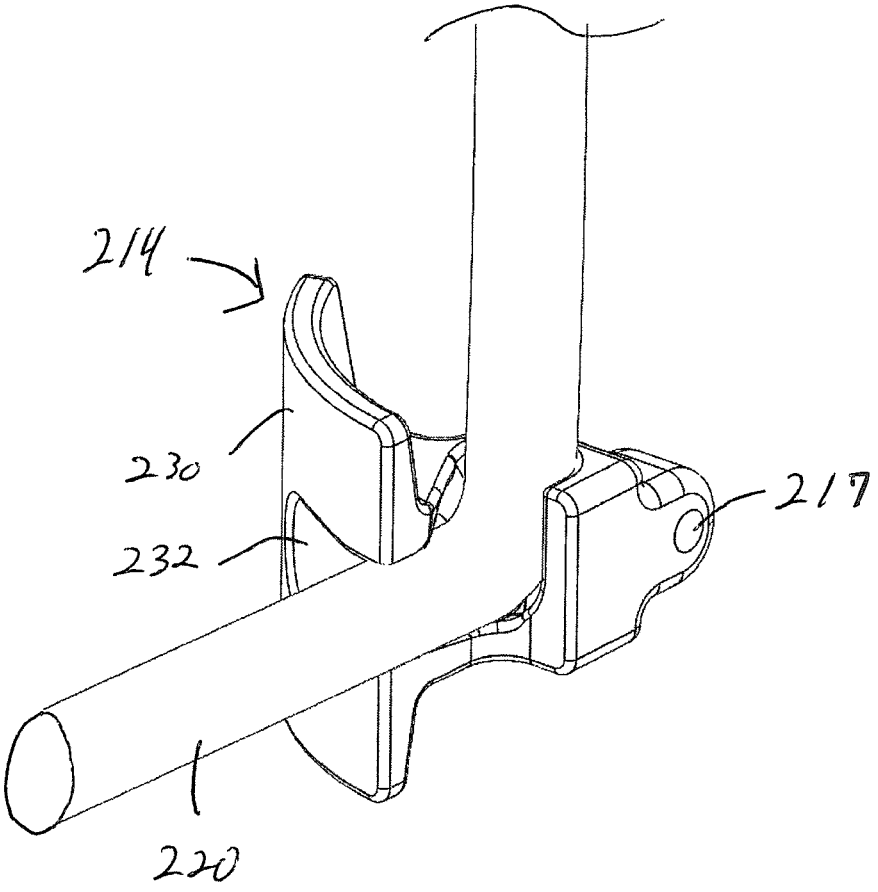
FIG. 13 shows the electrical cable running through the pivot member of FIG. 11.

FIGS. 11-13 illustrate a non-limiting example of joint structure 208 of an earcup to headband joint 206 for headphones. Joint structure 208 includes pivot member 210, which is similar to pivot member 91, and includes first end 212 that is able to move up and down along slider 140, as described above. Pivot member 91 also includes second end 214 that can pivot relative to first end 212 about pivot pin 215 that is received in opening 217. Cable 220 is carried by slider 140 and is re-routed (turned 90 degrees, generally along or parallel to the Y axis) into earcup 130 by pivot member 210, as best shown in FIG. 13. Second end 214 has bearing surface 320 which contacts bearing member 216 of joint structure 208. Bearing member 216 is similar to bearing member 70, but includes generally "U"-shaped outer portions 217 and 218. Bearing member 216 is attached to earcup 130 in the same fashion as illustrated in FIG. 9, by using fasteners such as screws (not shown) to attach tabs 162 to earcup shell pads 164. Cavity 232 is formed in pivot member second end 214 so as to accommodate and retain cable 220 such that it turns into the earcup. Cavity 232 may comprise a generally horizontal slot as shown, or the slot may be turned more vertically to better retain the cable.

As best shown in FIGS. 11 and 12, joint 206 also includes friction elements 222 and 224. Friction elements 222 and 224 are fixed to outer portions 217 and 218, respectively, of bearing member 216, which are designed to accommodate (i.e., fix-in-place) strips 222 and 224. Strips 222 and 224 can be fixed to bearing member 216 in a desired fashion, such as by an adhesive, or a mechanical faster. Alternatively, strips 222 and 224 could be overmolded onto bearing member 216. Strips 222 and 224 overlap slot 213 so as to either fully or partially close it off. The construction is such that the friction members contact opposed sides of cable 220. Friction members 222 and 224 are in this example thin strips of a pliable material, such as an elastomer. In one non-limiting example, the elastomer is a silicone rubber, which may be but need not be a material with a durometer of approximately Shore 50A. The friction elements are slightly deformed by cable 220 as the cable passes through them, as shown in FIG. 12. As the earcup pivots about the vertical (X) axis, cable 220 moves along horizontal slot 213 of bearing member 216 (which is similar to slot 71 of bearing member 70, FIG. 2); the friction between the upper surface 220*a* of the cable jacket and friction member 224, and between the lower surface 220*b* of the cable jacket and friction member 222 as the cable moves along the inner edges of the friction member strips, causes forces that damp (i.e., resist) the pivoting motion of the earcup. This force provides some feedback to the user as the earcup is pivoted, and also helps to maintain the final earcup rotational position and so to help keep the earcups in place as the user walks and moves.

Preferably, but not necessarily, the material and thickness and arrangement of the friction elements, together with the size (diameter) and jacket material of the cable, are selected to achieve a desired damping. The damping can be specified by an amount of torque created by these forces together with their offset from rotational axis X. The desired torque can be created using other arrangements of the elements of the earcup to headband joint structure, and/or the friction element or friction elements that provide forces that resist rotation about the X axis.

Figure 14:
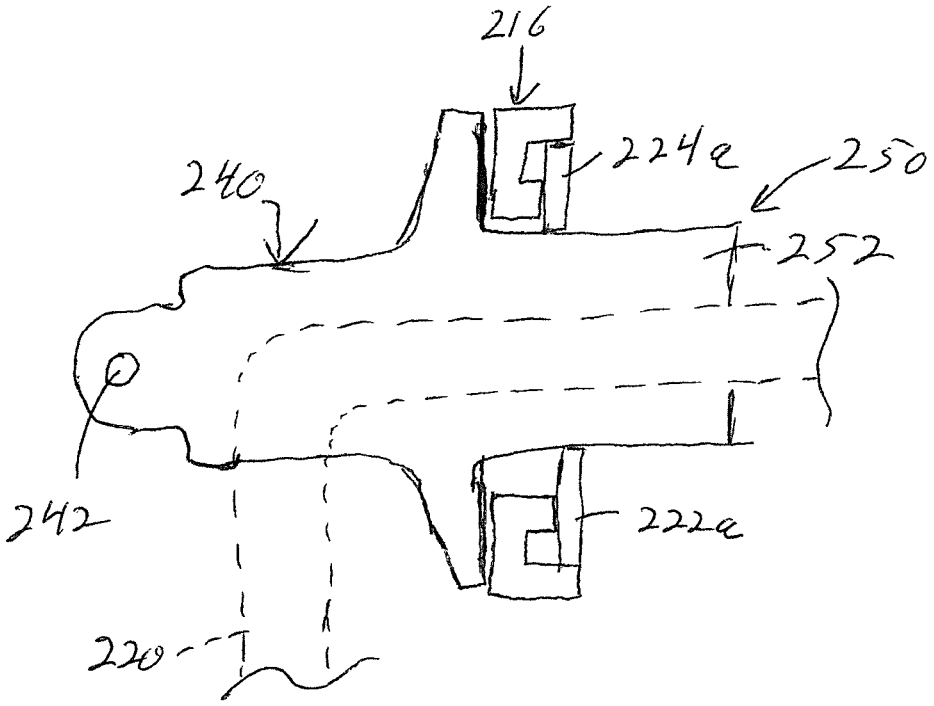
FIG. 14 illustrates an alternative pivot member and friction members.

One example of such an alternative arrangement is shown in FIG. 14, wherein alternative pivot member second end 240 includes extension portion 205. Portion 250 comprises tube 252 through which cable 220 runs. In this case, friction elements 222*a* and 224*a* (which are carried by bearing member 216) contact the outside of tube 252 rather than the outside of the cable as in the example of FIGS. 11-13. Other alternatives are within the scope of this disclosure and include the use of only one, or more than two, friction elements. For example, there could be one friction strip. Or, there could be a friction element (such as a sleeve) located on the cable or extension portion 205. Also, the friction could occur directly between the inner faces of bearing member 216 that form slot 213, and either the cable or the extension portion, thus obviating the need for separate friction elements and instead accomplishing friction elements directly in the bearing member (either by judicious choice of the bearing member material or by using a different material for the parts of the bearing member that define slot 213).

A number of implementations have been described. Nevertheless, it will be understood that additional modifications may be made without departing from the scope of the inventive concepts described herein, and, accordingly, other embodiments are within the scope of the following claims.

What is claimed is:

1. An earcup to headband joint for headphones, wherein the headphones comprise an electrical cable that extends from the headband into the earcup, and wherein the earcup comprises a slot, the earcup to headband joint comprising: a joint structure that couples the earcup to the headband and that is constructed and arranged to provide for earcup translation along a vertical axis and rotation about the vertical axis, wherein the electrical cable extends through the slot from the headband into the earcup either directly or through a joint structure tube; and at least one friction element in the earcup and in contact with at least one of the joint structure and the cable, wherein the friction element is constructed and arranged to provide forces that resist rotational motion of the earcup about the vertical axis.

2. The earcup to headband joint of claim 1, comprising two friction elements.

3. The earcup to headband joint of claim 2, wherein the electrical cable has two opposed sides, and one friction element is in contact with one side of the cable and the other friction element is in contact with the other side of the cable.

4. The earcup to headband joint of claim 3, wherein a horizontal portion of the cable runs generally along a horizontal axis that is perpendicular to the vertical axis, and wherein one friction element is above the horizontal portion of the cable and the other friction element is below the horizontal portion of the cable.

5. The earcup to headband joint of claim 2, wherein the friction elements each comprise a strip of pliable material.

6. The earcup to headband joint of claim 5, wherein the friction elements each comprise an elastomer.

7. The earcup to headband joint of claim 6, wherein the friction elements are made from silicone rubber.

8. The earcup to headband joint of claim 5, wherein the slot is generally horizontal and comprises two opposed sides, and wherein the strips are alongside both opposed sides of the slot.

9. The earcup to headband joint of claim 8, wherein the friction elements are made from silicone rubber.

10. The earcup to headband joint of claim 1, wherein the at least one friction element is spaced from the vertical axis.

11. The earcup to headband joint of claim 10, comprising two friction elements that each comprise pliable material.

12. The earcup to headband joint of claim 11, wherein the slot comprises two opposed sides, and wherein the friction elements are adjacent to both opposed sides of the slot.

13. The earcup to headband joint of claim 1, wherein the cable passes through the joint structure tube.

14. The earcup to headband joint of claim 13, wherein the friction element is in contact with the joint structure tube at a location where the cable passes through the joint structure tube.

15. An earcup to headband joint for headphones, wherein the headphones comprise an electrical cable that extends from the headband into the earcup, the earcup to headband joint comprising:

a joint structure that couples the earcup to the headband and that is constructed and arranged to provide for earcup translation along a vertical axis and rotation about the vertical axis, wherein the earcup comprises a generally horizontal slot that the joint structure and cable pass through; and at least two friction elements in the earcup, one alongside each side of the slot and in contact with at least one of the joint structure and the cable, wherein the friction elements are constructed and arranged to provide forces that resist rotational motion of the earcup about the vertical axis, wherein the friction elements comprise strips of an elastomer.

16. The earcup to headband joint of claim 15, wherein the friction elements are spaced from the vertical axis.

17. The earcup to headband joint of claim 16, wherein the friction elements overlap both sides of the slot.

18. The earcup to headband joint of claim 17, wherein the electrical cable has two opposed sides, and one friction element is in contact with one side of the cable and the other friction element is in contact with the other side of the cable.

19. The earcup to headband joint of claim 17, wherein the friction element is in contact with the joint structure at a location where the cable passes through the joint structure, and wherein the joint structure at the location where the cable passes through the joint structure comprises a tube in which the cable is located.

* * * * *